United States Patent [19]

Wayt

[11] 4,297,084

[45] Oct. 27, 1981

[54] GAS ANCHOR

[76] Inventor: Newell E. Wayt, 2272 Dominguez St., Torrance, Calif. 90501

[21] Appl. No.: 101,624

[22] Filed: Dec. 10, 1979

[51] Int. Cl.[3] ..... F04F 5/46

[52] U.S. Cl. ..... 417/179; 417/197

[58] Field of Search ..... 417/87, 89, 151, 169, 417/172, 176, 179, 180, 197, 198, 244

[56] References Cited

U.S. PATENT DOCUMENTS

| | | | |
|---|---|---|---|
| 134,397 | 12/1872 | Reed | 417/197 |
| 3,551,074 | 12/1970 | Stout | 417/198 X |
| 3,784,325 | 1/1974 | Coanda et al. | 417/197 X |
| 4,090,815 | 5/1978 | Teodoresgu et al. | 417/197 X |

*Primary Examiner*—Carlton R. Croyle
*Assistant Examiner*—Edward Look
*Attorney, Agent, or Firm*—Georges A. Maxwell

[57] ABSTRACT

A gas anchor for an oil and gas producing well; the gas anchor includes an elongate fluid gas conducting coupling with upper and lower ends; the upper end of the coupling is engaged in the lower end of a production tubing entering the well; an elongate vertical pipe is arranged in the well below the coupling; the pipe has a closed lower end, a perforated upper end portion and has an upper end engaged with the coupling; the coupling has a central vertical oil conducting passage; an elongate, vertical oil conducting stinger is arranged centrally in the pipe and has a lower end opening at the lower end portion of the pipe and an upper end communicating with the oil conducting passage; the coupling next includes a plurality of circumferentially spaced upwardly and radially inwardly inclined gas nozzle openings with lower end communicating with the interior of the pipe above the perforations and directing gas jets upwardly and inwardly to converge above the oil conducting openings whereby gas flowing up through the coupling lifts and aspirates oil collected in the bottom of the pipe and urges it up through the tubing.

5 Claims, 5 Drawing Figures

GAS ANCHOR

This invention relates to an oil well production tool and is particularly concerned with an improved gas anchor.

BACKGROUND OF THE INVENTION

In many producing oil wells, substantial quantities or volumes of gas, under considerable pressure, are produced. The gas production in such wells is generally conducted upwardly through the annulus defined by the well casings and the oil production tubings of the well structures and is dispersed through and from the casing heads at and closing the tops of the well casings.

The production or flow of gas in oil wells is oftentimes sufficient in volume and in pressure to interfere with the effective pumping of oil from such wells.

In the past and to assure effective pumping of oil from wells in which substantial volumes of gas is produced, the prior art has provided special production tools arranged at the lower ends of the production tubing to effect desired separation of gas and oil at the bottoms of the wells and to thereby present the oil in a condition in which it can be effectively pumped upwardly through the tubing and from the wells. The above noted tools are commonly referred to as "gas anchors" and are in the nature of sumps or catch basins arranged in the lower ends of the well structures. Gas anchors function to receive the gas and oil flowing from the earth's formation and permit the oil and gas to separate preparatory to pumping and removal of the oil from the wells. The separated gas flows out of the gas anchors and up through the annulus in the wells below the tubings and casings and the separated oil drops and is collected in the basin portions of the anchor structures, from which it can be pumped.

Further, in the case of oil wells which produce notable volumes of gas at substantial pressure, the prior art has sought to use the gas as a motive force to move or assist the movement of oil up through the production tubing. To this end, the prior art has provided production tools which serve or function to introduce gas into production tubings at one or more locations above the lower ends of the tubings to blow and/or urge oil in the tubings upwardly therein and/or to "lighten" the hydrostatic head on the column of oil in the tubing. Such tools are commonly referred to as "gas lifts".

Gas anchors provided by the prior art have taken many different forms which are quite effective to separate the gas and oil in the wells in which they are arranged and to thereby facilitate the pumping and movement of oil from the wells, but do little or nothing more than separate the gas and oil.

Gas lifts provided by the prior art have taken many different forms which are quite effective to move and advance oil upwardly through the production tubing of wells in which they are used. As a rule, the most effective gas lifts are those gas lifts which function to commingle and mix the gas and oil in the production tubings to an extent or to a degree that the production fluids within the tubings can be put into a light, easy-to-move mixture from which the gas does not escape and from which the oil does not settle at an excessive rate, as it is transported or moved upwardly through the production tubing.

As a general rule, gas lifts are positioned in their related strings of production tubing at one or more locations spaced above the lower ends of the tubing strings and above the pumps at the lower ends of the tubing strings. The gas from the wells is conducted up in the well structures through the annulus between the casings and production tubing strings to the gas lifts and is introduced into the tubing strings by the gas lifts. The annuli between the casings and tubing strings are sealed at the tops of the wells by casing heads and in some instances are suitably packed or sealed off adjacent the gas lift tools to effect desired control of the flow of gas in the well structures.

OBJECTS AND FEATURE OF THE INVENTION

An object and a feature of this invention is to provide an improved gas anchor operable to receive and separate gas and oil produced by an oil well in which the anchor is related, collect the oil preparatory to its being removed from the well, and including a gas operated oil extractor means to move the collected oil upwardly into and through a related string of production tubing in the well structure.

It is another object and feature of my invention to provide a novel gas anchor of the general character referred to above which operates to collect oil produced by the well in which the anchor is related and in which the extractor means comprises an aspirator structure through which gas produced by the well is conducted to aspirate or extract the oil collected by the anchor and to advance the oil upwardly into and through the production tubing of the well structure.

Yet another object and feature of the present invention is to provide a novel gas anchor of the character referred to above wherein the gas and oil flowing through it and moving upwardly into and through its related production tubing are commingled and mixed together to establish a light gaseous blend of oil and gas which is such that it moves or can be moved easily and freely upwardly through said tubing.

Finally, it is an object and feature of my invention to provide an improved gas anchor of the general character referred to above which includes no moving parts; a structure which includes but four principal parts, each of which is simple, easy and economical to make; and a structure which is highly effective and dependable in operation and which is safe and trouble-free for use in substantially any well structure in which a gas anchor can be effectively used.

The foregoing and other objects and features of my invention will be apparent and will be fully understood from the following detailed description of one typical preferred form and embodiment of my invention throughout which description reference is made to the accompanying drawings.

DETAILED DESCRIPTION OF THE INVENTION

Figure 1:
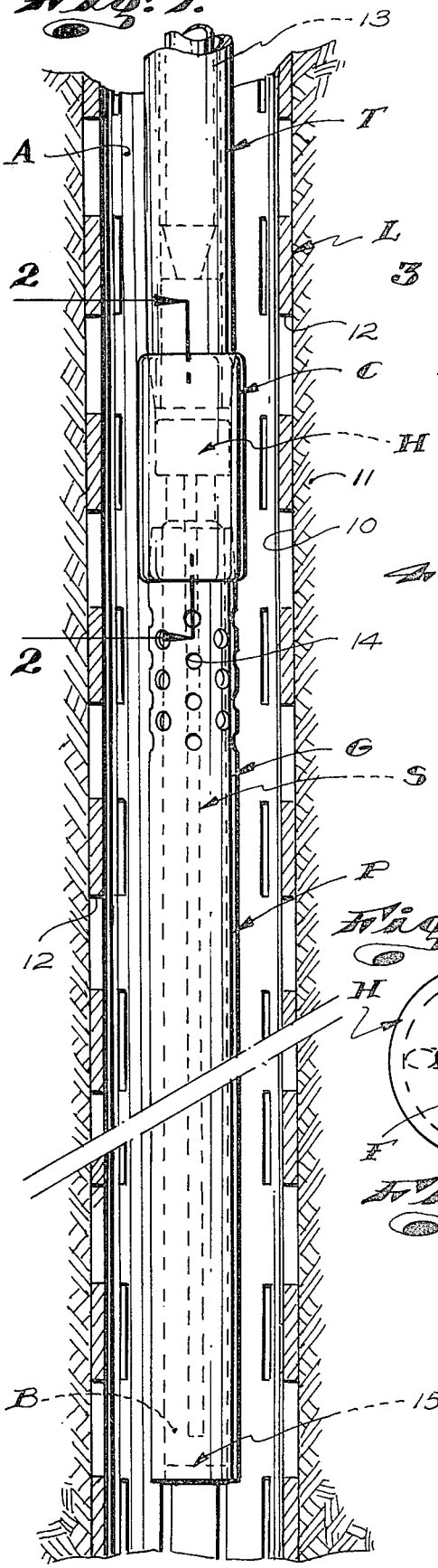
FIG. 1 is a vertical sectional view of the lower portion of a well structure in which my new gas anchor is incorporated.

In FIG. 1 of the drawings, I have shown the lower end portion of a typical well structure. The well structure comprises a bore or well-hole 10 drilled in an oil and gas producing earth formation 11. The bore 10 is lined with and the formation 11 is supported by a perforated liner L which extends downwardly from the lower end of a well casing (not shown). The above referred to casing extends upwardly through the bore 10 to the earth surface and is, in accordance with common practice, closed at its upper end by a casing head (not shown). The casing, like the liner L, supports the earth formation defining the bore 10. The liner L is supported or suspended from the lower end of the casing by a liner hanger (not shown) and is perforated, as at 12, to allow the gas and oil production flowing from the formation 11 to enter the well structure.

In addition to the casing, casing head, liner hanger and liner L, the well structure includes a string of production tubing T, less in diametric extent than the casing and the liner L and arranged centrally thereof to define and annulus A. The tubing T extends from the lower portion of the well structure upwardly through the casing and out through the casing head.

Since the casing, casing head, liner hanger, liner L and production tubing T are standard and/or conventional parts of well structures which are known to those skilled in the art to which my invention relates, and since the details of construction of those parts and their exact relationships with each other in well structures can vary widely in practice without departing from or affecting the novelty of my invention, I have elected not to illustrate the whole or entire well structure and to thereby avoid unduly burdening this disclosure.

It is sufficient to note that the liner L is in fact but an extension of the noted well casing; that the annulus A defined by the liner L, casing, and the tubing T extends upwardly to the top of the well structure and is closed at its upper end by the casing head at the upper end of the casing. It is to be further noted that the upper end of the tubing T extends outwardly through and from the casing head and connects and/or communicates with means to receive the well's production, which production is conducted upwardly through the tubing T.

The lower end of the production tubing T terminates above the lower end of the well and is shown terminating within the perforated liner L.

In practice, a pump 13, shown in dotted lines in FIG. 1 of the drawings, can be set within the lower end of the production tubing to draw oil collected in the lower or bottom end of the well into the lower end of the tubing and to advance and deliver the oil upwardly through the tubing and out of the well structure. The pump 13 can be hydraulically, electrically or mechanically powered and/or driven, as desired, or as circumstances require.

In furtherance of my invention, the well structure briefly described above and parts of which are shown in FIG. 1 of the drawings, includes a novel gas anchor G at the lower end of the tubing T to depend therefrom and freely into and through the liner L.

The gas anchor G that I provide includes an elongate, vertical, tubular collar C having an upper end threadedly engaged and coupled with the lower end of the tubing T. The anchor G next includes an elongate vertical separator and collector pipe P with an upper end threadedly engaging and coupled with the lower end of the coupling C.

Figure 5:
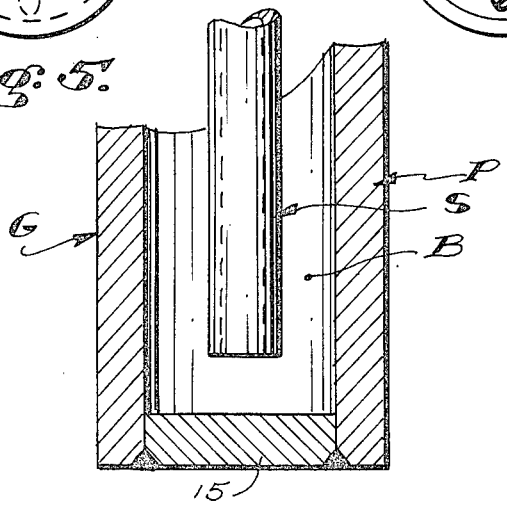
FIG. 5 is a sectional view taken substantially as indicated by line 5—5 on FIG. 1.

The upper end portion of the pipe P, immediately below the coupling C, is perforated as at 14 to allow for the free flow of oil into the upper end portion of the pipe and for the free flow of gas into and out of the pipe. The lower end of the pipe P is closed and sealed as by means of a plate 15 whereby the lower end portion of the pipe, below the perforations 14, establishes an oil collector or catch basin B (see FIG. 5 of the drawings).

The anchor G next includes an aspirator means H within the coupling C, through which gas in the upper portion of the pipe P flows upwardly and into the lower end of the production tubing T; and an elongate, tubular, vertical, fluid conducting pipe, hereinafter called the stinger S with an upper end coupled to and communicating with the aspirator means H and a lower open end terminating in the lower portion of the pipe P, within the catch basin B.

The aspirator means H is arranged substantially concentric with and substantially intermediate the upper and lower ends of the coupling C and has upper and lower or top and bottom ends 20 and 21, a central vertical oil or liquid conducting flow passage F and a plurality of longitudinally upwardly and radially inwardly inclined gas conducting passages or nozzle openings N in radial outward and circumferential spaced relationship from and about the central flow passage F.

The upper end of the stinger S communicates with the lower end of the central flow passage F. In the case illustrated, the stinger S is coupled with the aspirator means by a fluid conducting nipple 22.

Figure 2:
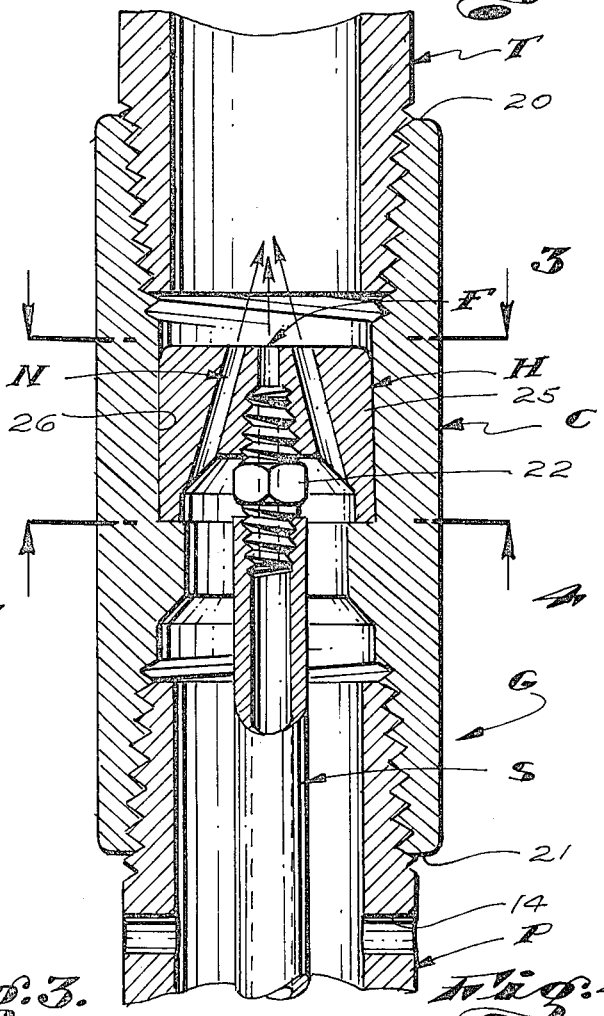
FIG. 2 is an enlarged detailed sectional view taken substantially as indicated by line 2—2 on FIG. 1.
Figure 3:
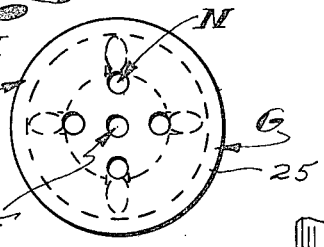
FIG. 3 is a sectional view taken as indicated by line 3—3 on FIG. 2.
Figure 4:
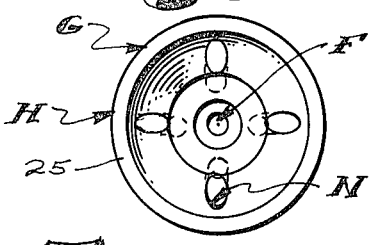
FIG. 4 is a sectional view taken as indicated by line 4—4 on FIG. 2.

The lower end of the nozzle openings N at the bottom end of the means H communicate with the interior of the pipe P at the upper end thereof. The upper ends of the nozzle openings N open at the top of the means H to communicate with the interior of the tubing T, at the lower end thereof and are disposed to direct jets of gas longitudinally upwardly and radially inwardly. The jets of gas are directed to converge with each other centrally of the construction immediately above the upper open end of the central flow passage F, as indicated by the arrows in FIG. 2 of the drawings, and to thereby create a minus pressure at and immediately above the upper open end of the passage F, which minus pressure effectively and efficiently draws oil upwardly from the catch basin B, through the stinger S and into the lower end of the tubing T.

In practice, the jets of gas are, for example, disposed at angles of about 15° from vertical and such that they converge and advance upwardly in the construction in such a manner as to forcibly move the oil drawn upwardly thereby, into and upwardly through the tubing T.

Of equal importance to the work of the aspirator means H to draw oil from the basin B and to advance it upwardly into the tubing T is the commingling, mixing and/or blending of the gas and the oil introduced into and advanced upwardly in the tubing T. The jets of gas issuing from the nozzle openings N converge with each other and with the oil drawn upwardly thereby to atomize and/or break up the oil into fine droplets and to effect a scrubbing together of the oil and gas in such a manner that the oil is super-saturated with and made light by the gas. The commingled and scrubbed together oil and gas establishes a mixture of gas and oil which is light, highly fluid and easy to advance upwardly through the tubing T and out of the well.

In the case of many wells which have a production rate of oil and gas which is particularly suited for use of my gas anchor, the worked upon and mixed together production of oil and gas remains light and free-flowing to and out of the tops of the wells. That is, sufficient separation of oil and gas worked upon to cause or prevent the oil from dropping down in the tubing T does not occur.

The above is believed to be due in part to the fact that the scrubbing action afforded by the aspirator means saturates the oil with gas and due in part to the fact that the continuous flow of gas in and through the tubing continues to scrub the oil and to maintain it saturated and light with gas and in or near to a state or condition of finely divided droplets.

In some wells, where the balance and volume of the production of oil and gas is suitable, my new gas anchor has been effective to cause those wells to produce oil, without the use of a pump, at a rate equal to or better than the oil production rate previously attained in those wells by use of conventional pumping means.

In other wells, where pumps were in place and used to move the production outwardly through the tubing T, my new gas anchor has proved effective to supplement the work of the pumps and to establish increased and more uniform production from those wells. Such increased and more uniform production is attributable to the fact that my new gas anchor functions to deliver production to the pumps at a substantially constant and uniform rate and conditions the oil so that it is light, more fluid, and more easily moved by and through the pumps.

There has been no experience of gas blocks developing in the pumps in such wells. This is attributable to the fact that production fluid (gas and oil) is delivered by the aspirator means H to the well pumps at a substantially continuous constant rate and maintains the pumps primed and functioning at all times.

In the form of the invention illustrated, the aspirator means H is shown in the form of a separate cylindrical, machined, head-like part 25 removably set in an upwardly opening cylindrical socket or seat 26 established in the coupling C. With this construction, the head-like part 25 can be easily removed from the coupling C for service and/or replacement when and if servicing and/or replacement of the aspirator means is required.

In practice, if desired, the aspirator means H can be easily and conveniently formed integrally in the coupling C, without in any way affecting or departing from the spirit of this invention.

In the form of invention illustrated, the head part 25 of the aspirator means H is provided with four circumferentially spaced gas conducting nozzle openings N. It will be apparent that the number of openings N can be increased and their size varied or changed, as desired or as circumstances require. Further, it will be apparent that the several openings N could be replaced by a single upwardly convergent annular nozzle passage or openings, about the opening F, without departing from the broader aspects and/or spirit of my invention.

The provision of four nozzle openings N shown in the drawings was selected or arrived at for purposes of convenience and ease of manufacture and has proven to be quite effective.

It will be apparent that the length of the pipe P can be varied as circumstances require. For example, for wells that produce oil at a slow rate, the longitudinal extent and open area of the upper perforated portions of the pipes P must be greater and the catch basins B in the lower ends of the pipes P need not be as great as is required for wells that produce oil at a notably faster rate. Accordingly, the length of the pipe P and the relative proportioning of the upper perforated portion and lower catch basin portions thereof is preferably designed to most effectively handle the production of particular wells.

As regards the aspirator means H, the size and/or number of gas nozzle openings and/or the size of the central oil or fluid passage can be varied in accordance with the volume and pressure of gas produced and the volume of oil produced by the well in which the anchor is to be used and so that the greatest possible work upon the gas and oil will be attained by the anchor.

Having described only one typical preferred form and application of my invention, I do not wish to be limited to the specific details herein set forth, but wish to reserve to myself any modifications and/or variations that may appear to those skilled in the art and which fall within the scope of the following claims:

Having described my invention, I claim:

1. A gas anchor comprising an elongate vertical coupling with means at its upper end to connect with the lower end of a production tubing, an elongate vertical pipe with an upper end connected with the lower end of the coupling, said pipe having an upper perforated portion to allow for the flow of gas and liquid radially into and out of the pipe and having a closed lower end defining a liquid catch basin below said upper perforated portion, aspirator means within the coupling including an upwardly opening central liquid conducting means and gas jet nozzle means about the central liquid conducting means and communicating with the pipe below the coupling and directing gas longitudinally upwardly and radially inwardly to converge above the liquid conducting means in aspiratory relationship therewith and an elongate vertical liquid conducting stinger with an upper end communicating with said liquid conducting means and a lower end communicating with said catch basin.

2. The gas anchor set forth in claim 1 wherein said central fluid conducting means includes a central vertical opening within the coupling and having an open upper end and a lower end connected with the upper end of said stinger, said gas jet nozzle means includes a plurality of longitudinally upwardly and radially inwardly inclined gas conducting nozzle openings in radial and circumferential spaced relationship about said central vertical opening and having upper and radially inwardly disposed outlet ends and substantially downwardly opening inlet ends communicating with the upper end of said pipe.

3. The gas anchor set forth in claim 2 wherein the liquid conducting opening and nozzle openings are in a cylindrical head connected with the upper end of the stinger and said head is seated and supported in an upwardly opening socket in the central portion of said coupling.

4. The gas anchor set forth in claim 1 wherein the coupling is a tubular part and has a central upwardly opening socket, said aspirator means includes a cylindrical head connected with the upper end of the stinger and defines said liquid conducting means and gas jet nozzle means, said head is positioned in seated supported engagement in said socket.

5. The gas anchor set forth in claim 4 wherein the upper end of the pipe is threadedly engaged into the lower end of the coupling and the upper end of the coupling has threaded coupling means to engage the lower threaded end of a related production tubing.

* * * * *